US011137723B2

(12) United States Patent
Hauk

(10) Patent No.: US 11,137,723 B2
(45) Date of Patent: Oct. 5, 2021

(54) PROFESSIONALLY CUSTOMIZABLE TIMEPIECE

(71) Applicant: UPHILL PROJECTS GMBH, Hilchenbach (DE)

(72) Inventor: Stefan Hauk, Hilchenbach (DE)

(73) Assignee: UPHILL PROJECTS GMBH, Hilchenbach (DE)

( * ) Notice: Subject to any disclaimer, the term of this patent is extended or adjusted under 35 U.S.C. 154(b) by 0 days.

(21) Appl. No.: 16/959,948

(22) PCT Filed: Jan. 4, 2019

(86) PCT No.: PCT/EP2019/050126
§ 371 (c)(1),
(2) Date: Jul. 2, 2020

(87) PCT Pub. No.: WO2019/154564
PCT Pub. Date: Jan. 4, 2019

(65) Prior Publication Data

US 2021/0034019 A1 Feb. 4, 2021

(30) Foreign Application Priority Data

Jan. 4, 2018 (DE) ..... 10 2018 000 040.1

(51) Int. Cl.
*G04B 37/14* (2006.01)
*G04B 37/05* (2006.01)
*G04B 47/00* (2006.01)

(52) U.S. Cl.
CPC ..... *G04B 37/1426* (2013.01); *G04B 37/05* (2013.01); *G04B 47/00* (2013.01)

(58) Field of Classification Search
CPC .... G04B 39/02; G04B 37/1426; G04B 37/05; G04R 47/00
See application file for complete search history.

(56) References Cited

U.S. PATENT DOCUMENTS 1,289,155 A * 12/1918 Goal ..... A45C 11/10 368/286
2,989,838 A * 6/1961 Willi Guggi ..... G04B 37/0008 368/292

(Continued)

FOREIGN PATENT DOCUMENTS

CH 700416 A2 8/2010
DE 37 40 043 A1 12/1988

(Continued)

OTHER PUBLICATIONS

International Search Report issued by the European Patent Office in International Application PCT/EP2019/050126.

*Primary Examiner* — Sean Kayes
(74) *Attorney, Agent, or Firm* — Henry M. Feiereisen LLC

(57) ABSTRACT

A professionally customizable timepiece includes a primary casing including a movement and configured to operate independently as a timepiece, and a secondary casing having an interior space for receiving the primary casing and further design elements. The secondary casing completely encloses the interior space and can be opened without tool for placement of the primary casing and/or design elements into the interior space or to remove them from there. The secondary casing includes a sight glass and is configured to secure the primary casing at a selectable position in the interior space.

12 Claims, 10 Drawing Sheets

(56) References Cited

U.S. PATENT DOCUMENTS

| | | | | |
|---|---|---|---|---|
| 3,638,418 | A * | 2/1972 | Spadini | G04C 21/02 368/74 |
| 4,932,010 | A | 6/1990 | Perucchi | |
| 6,819,632 | B1 * | 11/2004 | Paul | G04B 45/0092 368/88 |
| 7,081,905 | B1 * | 7/2006 | Raghunath | G06F 1/163 345/684 |
| 9,146,538 | B2 * | 9/2015 | Hembo | G04B 45/00 |
| 9,737,123 | B2 * | 8/2017 | Wright | A45C 13/008 |
| 2005/0083789 | A1 | 4/2005 | Matatov | |
| 2006/0018200 | A1 | 1/2006 | Pitocco et al. | |
| 2007/0189127 | A1 * | 8/2007 | Pollak | G04B 37/1486 368/294 |
| 2007/0253290 | A1 | 11/2007 | Aire | |
| 2010/0302913 | A1 * | 12/2010 | Loiseau | G04B 37/0427 368/281 |
| 2012/0092967 | A1 | 4/2012 | Courvoisier et al. | |
| 2017/0357221 | A1 * | 12/2017 | Park | G06F 3/03547 |

FOREIGN PATENT DOCUMENTS

| | | | | |
|---|---|---|---|---|
| DE | 9406143 | U1 | 10/1994 | |
| DE | 202010 572 | U1 | 4/2003 | |
| DE | 102005054108 | A1 * | 11/2005 | G04B 37/00 |
| DE | 102010035501 | A1 | 3/2012 | |
| DE | 102014011430 | A1 | 2/2016 | |
| EP | 1 684135 | B1 | 5/2008 | |
| EP | 2 283 399 | B1 | 9/2014 | |
| EP | 2577406 | B1 | 12/2014 | |

* cited by examiner

PROFESSIONALLY CUSTOMIZABLE TIMEPIECE

CROSS-REFERENCES TO RELATED APPLICATIONS

This application is the U.S. National Stage of International Application No. PCT/EP2019/050126, filed Jan. 4, 2019, which designated the United States and has been published as International Publication No. WO 2019/154564 A1 and which claims the priority of German Patent Application, Serial No. 10 2018 000 040.1, filed Jan. 4, 2018, pursuant to 35 U.S.C. 119(a)-(d).

BACKGROUND OF THE INVENTION

The invention relates to a customizable timepiece with primary and secondary casings.

In the low-end price category, timepieces and especially wristwatches only have spot-like differentiation features. In the higher end price category, the names of large, long-established manufacturers and luxury brands are oftentimes decisive for the purchase. In addition to specialty stores, discounters and global web shops offer a wide range of models in almost all price categories. Even renowned watch brands are increasingly being sold on Internet portals. Furthermore, the so-called smartwatches capture a significant market share.

The solution proposed here realizes the wishes of female and male watch wearers with regard to individuality and versatility. This brings the timepiece and, preferably, the wristwatch closer to the definition of a lifestyle product and even has the potential to become the subject of communication in modem media.

At the same time, the basis for a simple, high-quality and basic timeless design is created by high-quality components and noble materials, wherein the design can be modified, optimized or completely renewed by the female or male watch wearers without expert knowledge.

The state of the art provides various novel design options for the female watch wearer who is not equipped with expert knowledge.

EP 2 283 399 B1 shows a modular movement that is fully functional on its own. It is exchangeable In portable devices, i.e., e.g., in wristwatch cases, without tools. The modular movement is hereby inserted into the opening of a receptacle via the rear facing the body. The watch glass of the modular movement becomes the watch glass of, e.g., wristwatch. The modular movement also forms the backside facing the body of the wearer and is thus, at least in part, held in the wristwatch receptacle by the body of the person wearing it.

DE 10 2010 035 501 A1 also describes a modular movement. The movement casing and watch glass form a sealed unit which is rotatably supported and securable in a watch case. Turning of the modular movement within the watch case attains an advantageous setting of the time display. Furthermore, the design of the watch can be modified by the female watch wearer through the rotational degree of freedom.

DE 202 10 572 U1 also describes a modular movement, which is firmly connected as a sealed unit to the upper or front watch case. The front watch case, which is visible for reading the time, is in turn radially movably connected to the rear case part facing the arm of the female wearer. The connection is realized via a centering or bearing screw, which is positioned centrally in the case.

EP 1 684 135 B1 discloses a watch case with rotatable cover/bezel combination. This is attached to a shaft, which is located in the middle of the case. The movement has at least one eccentric display. The cover/bezel combination can be brought into different rotary positions by the female or male watch wearer. The eccentric displays become therefore invisible or visible. Moreover, there is a rotary position in which none of the displays are visible.

EP 2 577 406 B1 describes a wristwatch, the aesthetic appearance of which can be changed by a layperson and without tools. Movement, movement case and watch glass are arranged in midsection as an independent, sealed unit. Two annular flanges are arranged on the outer circumference of the casing, between which there is a circumferential groove. After lifting off the bezel, which is connected to a second cover glass, the layperson can insert movable elements into the circumferential groove. After the bezel and cover glass have been installed, rotation of this cover element is no longer provided.

In summary, the prior art discloses the following.

EP 2 577 406 B1 enables introduction of individual design elements by the layperson. This is realized in a circumferential groove arranged on the outer circumference of the casing. A small receiving space is the result, which is restricted by the required mechanics with many precisely fitted individual elements. The upper bezel-glass combination can be removed to introduce the individual design elements, however is no longer rotatable when assembled. Furthermore, EP 2 577 406 B1 describes a modular movement which is operational independently as a sealed unit. This can neither be dismantled nor rotated.

EP 2 283 399 B1, DE 10 2010 035 501 A1 and DE 202 10 572 U1 likewise disclose a modular movement which is operational independently as a sealed unit. In the description of EP 2 283 399 B1 and DE 10 2010 035 501 A1, this modular movement can be removed or replaced by the layperson. In the case of DE 10 2010 035 501 A1 and DE 202 10 572 U1, the modular movement is rotatable, DE 202 10 572 U1 describes a variant, in which the modular movement is firmly connected to the front watch case. The front watch case, which is visible for reading the time, is in turn radially movably connected to the rear case part facing the arm of the female wearer. In this way, the rotatability is realized. For this purpose, a center axis that limits the installation space is required.

A comparable center axis is shown in EP 1 684 135 B1. It enables the bezel-glass combination to be rotated but not its disassembly. Furthermore, the movement is not constructed modular and can also not be dismantled, DE 10 2014 011 430 A1 discloses an analog watch with a main display and a secondary display as well as separately rotatable bezels for displaying different time zones.

DE 37 40 043 A1 discloses a watch having an upper side which includes separate regions with the display field of a movement and for accommodating an exchangeable insert which can be individually customized.

US 2007/0253290 discloses a self-contained functional watch, which can be accommodated in a receptacle at a fixed position.

US 2012 092 967 discloses a watch having a movement and a display device which can be screwed together at different angles.

US 2006/018200 discloses a watch with a container integrated on the backside for receiving medication.

U.S. Pat. No. 4,932,010 discloses an analog movement, which is arranged in the center of a watch case and is coupled to an eccentrically positioned display via gearwheels.

US 2005/83789 discloses a watch case in which several watch movements for displaying different time zones are arranged at predetermined positions.

Furthermore, DE 10 2005 054108 A1 discloses to a modular watch in which the movement is mounted between a top part and a bottom part while damping a cover glass.

The primary object of the invention disclosed herein is the creation of a professionally customizable timepiece. The preferred embodiment is a wrist watch.

SUMMARY OF THE INVENTION

The objects of the invention are achieved by a professionally customizable timepiece with

- at least one primary casing, which accommodates a movement and is operational independently as a timepiece; and
- a secondary casing, which has an interior space for receiving the primary casing and other design elements, with the secondary casing

- completely enclosing the interior space;
- capable of being opened without tools so as to introduce the primary casing and/or design elements into the interior space or to remove them from there;
- including a sight glass;
- including means for securing the primary casing at a selectable position in the interior space, Preferred embodiments are set forth in dependent claims.

In this context, "movement" includes, as usual, the components inside a watch which are required to generate and display a measure of time, i.e., e.g., gears, drive and display in an (electro-) mechanical watch, or electronic components in an electronic (quartz) watch. Different therefrom is the casing which accommodates the movement and protects it from mechanical influences. The fact that the primary casing with the movement contained therein "is operational independently as a timepiece" means in particular that it is mechanically sealed (protected) on its own and fulfills all the functions of a watch (measurement and display of the time). Normally, the primary casing could therefore easily be worn by a user as a watch.

The fact that the secondary casing should be able to be opened "without tools" means that a user can open it (and preferably also close it) by hand alone and without further aids, although easier opening with the aid of tools is, of course, not excluded.

The sight glass is typically arranged in such a way as to allow the user to see the primary casing from the outside (and there preferably upon the time display). Furthermore, design elements that have been introduced into the secondary casing should also be visible through the sight glass.

The means for securing the primary casing at a selectable position in the interior space of the secondary casing may basically be of any design and may include a securement through interference fit (e.g. clamping, securement with magnetic forces), form fit (e.g. accommodation in a pocket) or material joint (e.g. gluing). Securement should preferably be (slightly) reversible and undone again free of residues or damages. The "selectable positions" can be discretely predefined, i.e. fixed in specific number, or they can be distributed continuously within the interior space.

The center axes of primary and secondary casings are, optionally, not identical. For example, the center axis of an essentially cylindrical casing is defined by the cylinder axis. In the case of the primary casing, the center axis generally coincides with the rotation axis of mechanical hour and minute hands (if available).

In a preferred embodiment, the secondary casing is comprised of a top part and a bottom part and can be opened or closed by manual operation without tool. For example, the top part and bottom part can have an external thread or an internal thread in order to be able to be screwed together. They can preferably also be connected to one another in a bayonet-like manner.

According to a refinement of the preceding embodiment, the top part including the sight glass of the secondary casing can be rotated about its center axis as desired in the assembled state, without movement of an accommodated primary casing. The top part typically rotates hereby in relation to the bottom part.

In the embodiment with top part and bottom part, the top part can, optionally, be dismantled from the bottom part by hand and without further aids only after a preferably screw-like securing element has been removed. Without removal of the securing element, the top part and bottom part thus remain coupled and cannot inadvertently detach from one another. In this context, it is further optional to enable dismounting of the top part (after removal of the securing element) from the bottom part by hand and without further aids in certain predefined angular positions only—preferably only in one to four angular positions.

In the embodiment with the top part and bottom part, the top part and bottom part of the secondary casing can optionally have on the outer circumference several, preferably not symmetrically subdivided groove sections, which, starting from the central symmetry axis of the secondary casing, alternate on the circumference and complement one another to form a single circumferential groove so as to enable assembly of the top and bottom parts with a displacement along the symmetry axis.

The primary casing is generally advantageously shockproof and sealed against solid, liquid and gaseous media. The respective protection of the movement can then be fulfilled solely by the primary casing.

Furthermore, the timepiece may be provided with at least one optical element, which is attached off-center in the interior of the secondary casing and can rotate about the vertical axis of the secondary casing, and which can be locked in any angular position. The optical element can be, for example, a lens with which the user can view various objects in the interior space of the secondary casing enlarged, dependent on the rotational position of the lens.

The secondary casing can further include wristband lugs, so that the timepiece can be worn as a wristwatch with a wristband made of metal, leather, synthetic leather, rubber or plastic.

In particular, the timepiece can have at least one wristband lug, which is reversibly attached or attachable to the secondary casing. This has the advantage that the individual design freedom is further enhanced by enabling a secondary casing to be selectively combined with different wristband lugs. In addition or as an alternative, several types of attaining a connection between the wristband lug and the secondary casing can also be provided, for example by different positions of the connection between wristband lug and the secondary casing, thereby offering further design freedom. Furthermore, the separate connectivity of wristband lug and secondary casing usually also has manufacturing advantages.

Preferably two wristband lugs are provided which both can be reversibly connected to the secondary casing.

There are various options for realizing the reversible connectivity between the wristband lug and the secondary casing. For example, the wristband lug could be screwed onto the secondary casing via a thread formed on it and/or with the aid of screws. In a preferred embodiment, the wristband lug has a projection which can be inserted into a recess of the secondary casing and which can be locked in the secondary casing, so that the wristband lug can no longer be inadvertently detached from the secondary casing. Locking may hereby be implemented by interference fit or by form fit.

In one embodiment of the secondary casing with top part and bottom part, the afore-mentioned locking is preferably realized "automatically" as the top part and bottom part are joined together. For example, the projection of the wristband lug could be clamped by interference fit when the top part and bottom part are joined together. Advantageously, locking is implemented through a form fit, for example by engaging the top part in a depression, groove or the like of the projection.

Furthermore, the timepiece can have a positioning element which can be connected to the primary casing and effects a securement of the primary casing in the secondary casing (i.e. serves as a means for securing the primary casing at a selectable position in the interior space of the secondary casing). In this case, the positioning element can act as a type of adapter between primary casing and secondary casing, so that it becomes possible to secure various types and shapes of the primary casing in the secondary casing.

The positioning element can be connected to the primary casing by gluing, for example, in addition or as an alternative, the positioning element can interact with the secondary casing in a form-fitting manner in order to secure the position of the primary casing. For example, the bottom of the secondary casing can have specifically shaped depressions into which the positioning element can be fitted (i.e. typically non-rotatably and/or immobile).

The preferred embodiment of the timepiece is a wristwatch.

BRIEF DESCRIPTION OF THE DRAWING

To better explain the invention, optional features are shown in the figures. It is shown in.

DETAILED DESCRIPTION OF PREFERRED EMBODIMENTS

Figure 1:
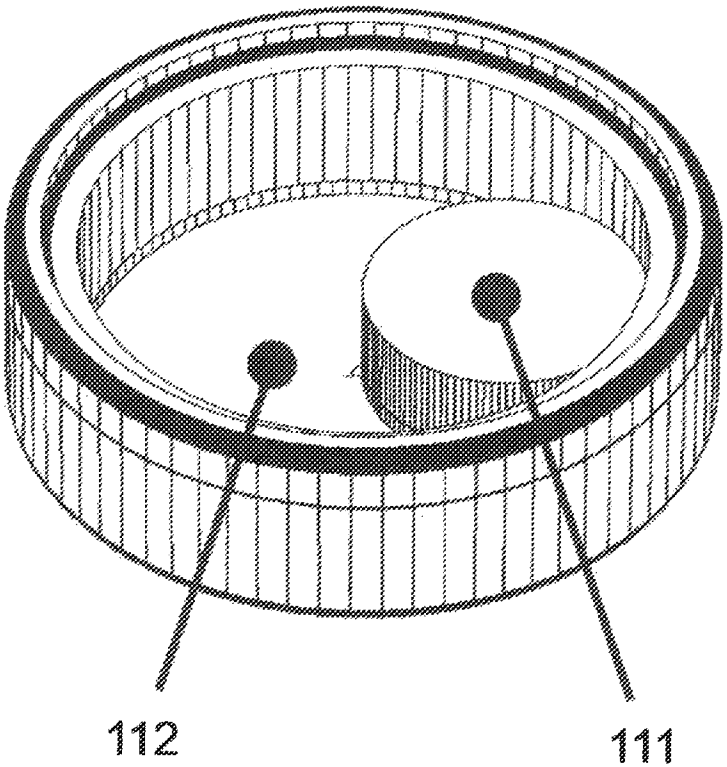
FIG. 1: timepiece with a primary casing 111 in the secondary casing 112.
Figure 10:
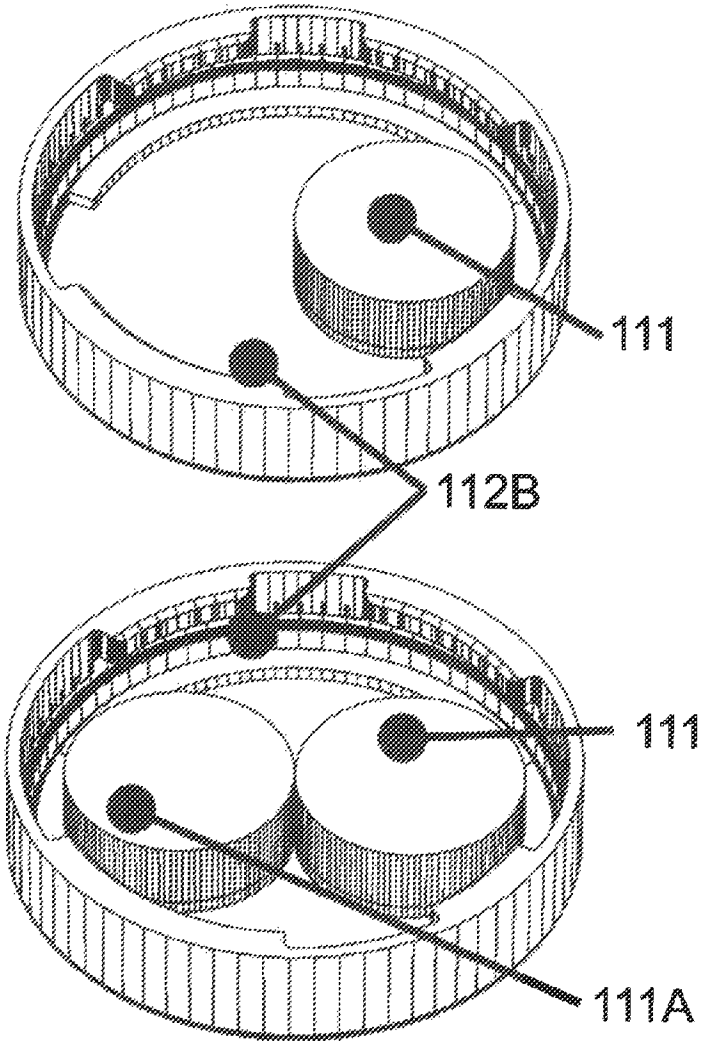
FIG. 10: bottom part 112B of the secondary casing with one inserted primary casing 111 (above) and with two inserted primary casings 111, 111A (below)

According to FIG. 1, the individually customizable timepiece includes at least one primary watch case 111 (primary casing) and at most one secondary watch case 112 (secondary casing). The lower depiction in FIG. 10 shows by way of an example an individually customizable timepiece with two primary casings 111, 111A and the bottom part of the secondary casing 112B.

Figure 3:
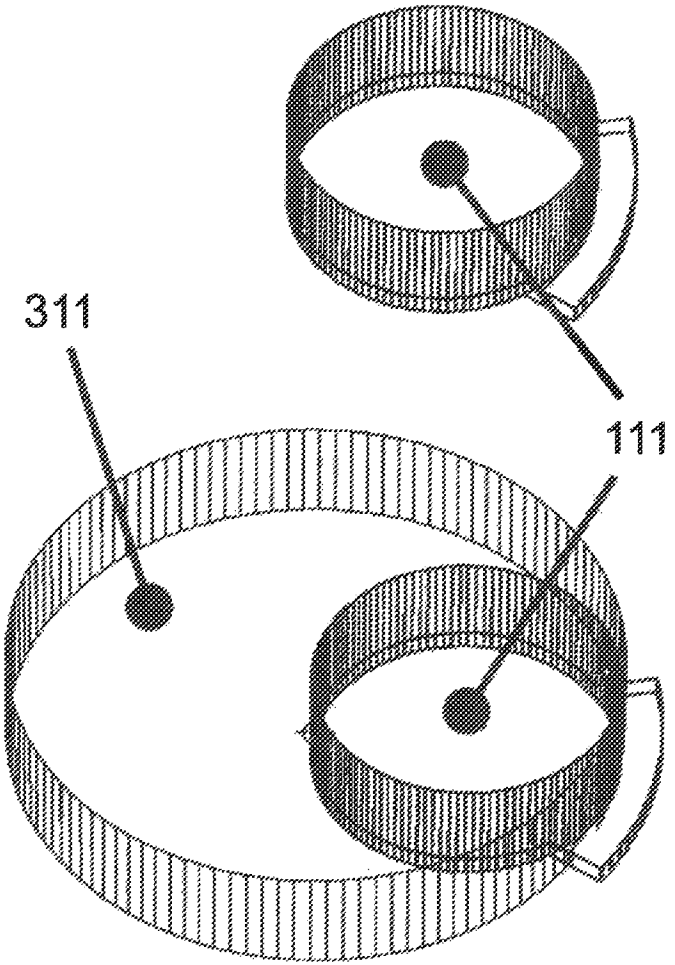
FIG. 3: primary casing 111 and next to the primary casing the design space 311 remaining in the secondary casing for own ideas.

Each primary watch case, which directly surrounds the movement and the hands, assumes hereby all functionally relevant properties such as time display, shock resistance and tightness against solid, liquid and gaseous media. The secondary watch case completely surrounds the primary casing. In addition to the primary watch case including timepiece, the male or female watch wearer may himself or herself also creatively design additional contents in the secondary watch case. Since the primary watch case is typically significantly smaller in volume than the secondary watch case, there is also a significantly large receiving space for own ideas in the secondary casing. The receiving space for own ideas is designated by numeral 311 (FIG. 3). From the entire interior space in the secondary casing, only the space occupied by the primary casing 111 has to be subtracted. Expert knowledge is not required to design the receiving space.

The timepiece is intended to provide the female watch wearer, the jewelry designer or the female goldsmith with a maximally large receiving space within the casing for introducing individual design elements. This receiving space should extend to the interior space of the secondary casing below the sight glass and not only relate to a groove on the outer circumference. Introduction of individual design elements should be rendered possible without watchmaker expertise, without tools and without adversely affecting the watch function. The creation of a possibility of rotating the sight glass on the secondary casing about the vertical axis of the secondary casing is also an option of the invention. This rotational degree of freedom serves to achieve additional optical effects.

Furthermore, minimizing the necessary individual parts and thus avoiding complex mechanical elements is advantageous. Minimization is desirable in order to maximize the receiving space made available in the secondary casing for individualization. Not least, the artistic craft, especially in the jewelry design and goldsmith industries, should also be provided with a large receiving space for creative design and introduction of professional works for their customers.

The primary watch case 111, 111A surrounds the movement and the hands in case of analog display. It operates independently. Furthermore, it is preferably shockproof and tight against solid, liquid and gaseous media.

Figure 4:
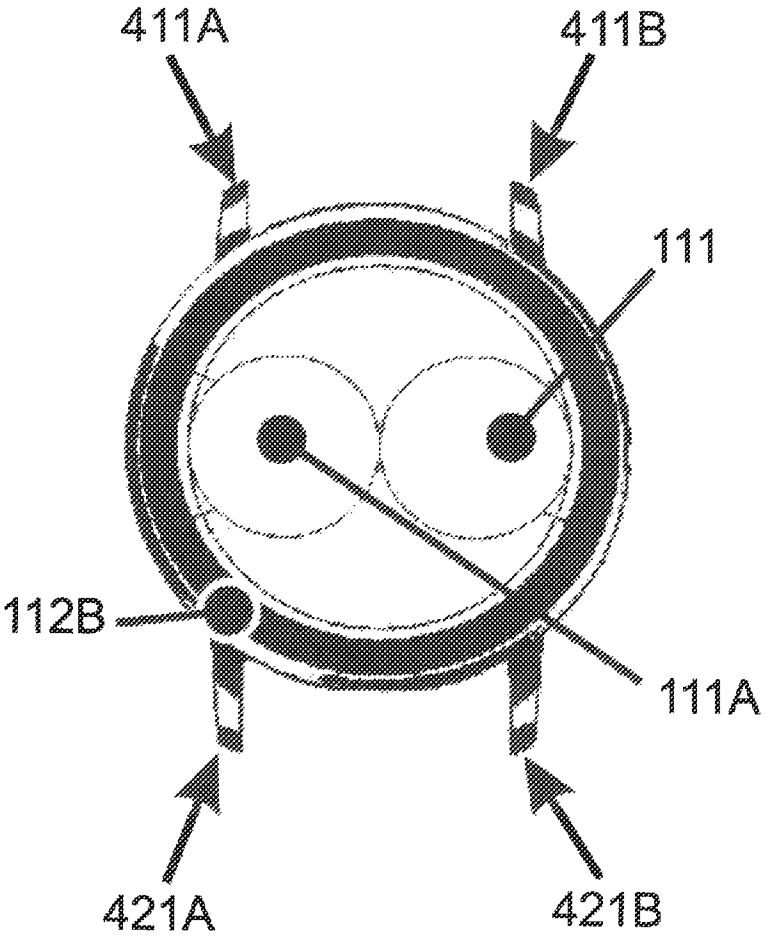
FIG. 4: plan view of a professionally customized timepiece with attached band lugs 411, 421.
Figure 5:
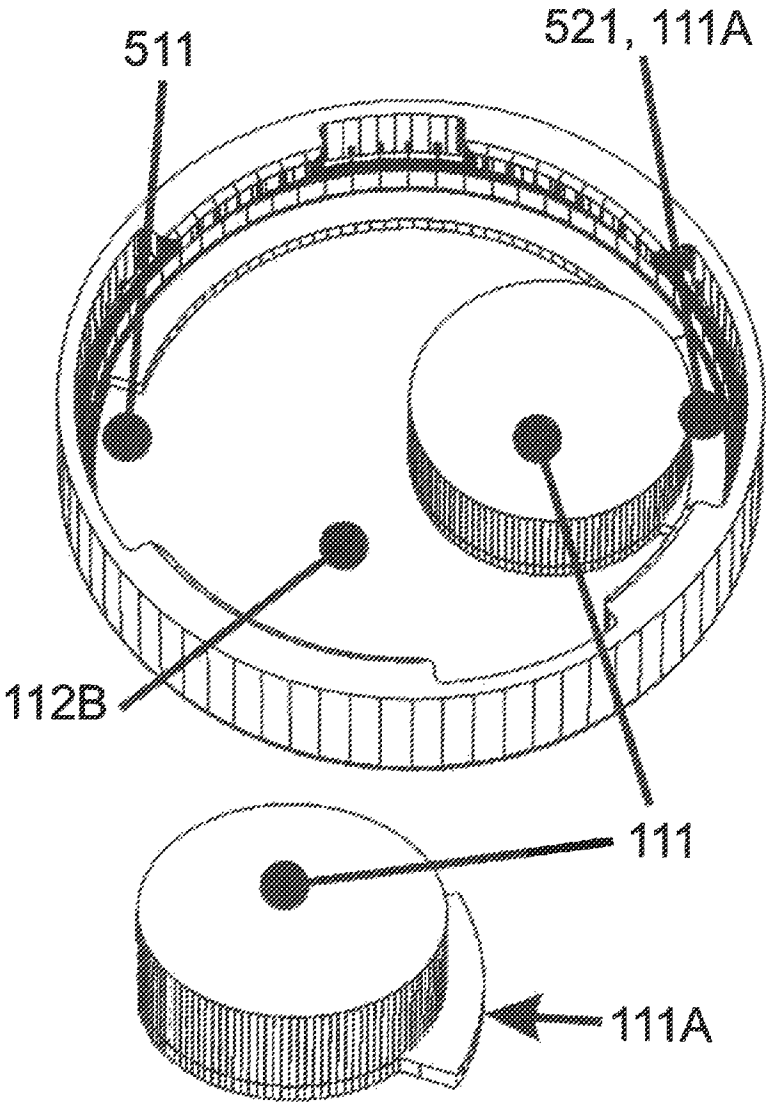
FIG. 5: bottom part of the secondary casing with inserted primary casing 111 and defined mounting points 511, 521, which attach the primary casing in five degrees of freedom.

The secondary watch case 112 completely surrounds the primary watch case. It is preferably comprised of a bottom part 1126, which in a preferred embodiment receives band lugs (411A, 411B, 421A, 421B FIG. 4; 1113 FIG. 11) for a watch band. Furthermore, it can optionally contain geometric recesses (511, 521 FIG. 5) which are intended for the defined accommodation of the primary watch case. In a preferred embodiment, the defined receptacles are shown in FIG. 5. Also shown is the counterpart 111A on the primary casing 111 for the receptacle. This involves a protruding projection 111A, which can be inserted formfittingly into a recess 511, 521 and thereby secures the primary casing in place.

Figure 6:
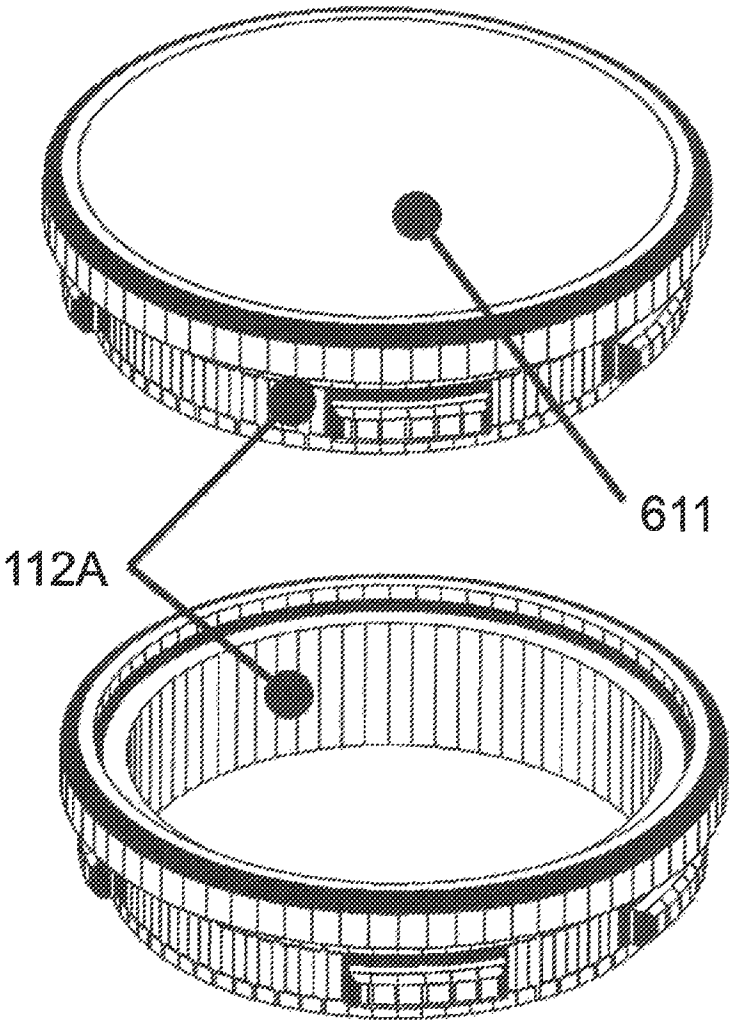
FIG. 6: top part 112A of the secondary casing with inserted sight glass 611 (above) and without sight glass (below)

Furthermore, the secondary watch case preferably includes a top part (112A), which has a sight glass (611, FIG. 6) to view the primary watch case inside. Top part and sight glass are typically firmly connected with one another and can only be separated by tools. When assembled, the union of top part and sight glass can always be rotated about its center axis and can be locked at any angular position in relation to the bottom part of the secondary casing. In this way, additional optical effects are created.

Figure 2:
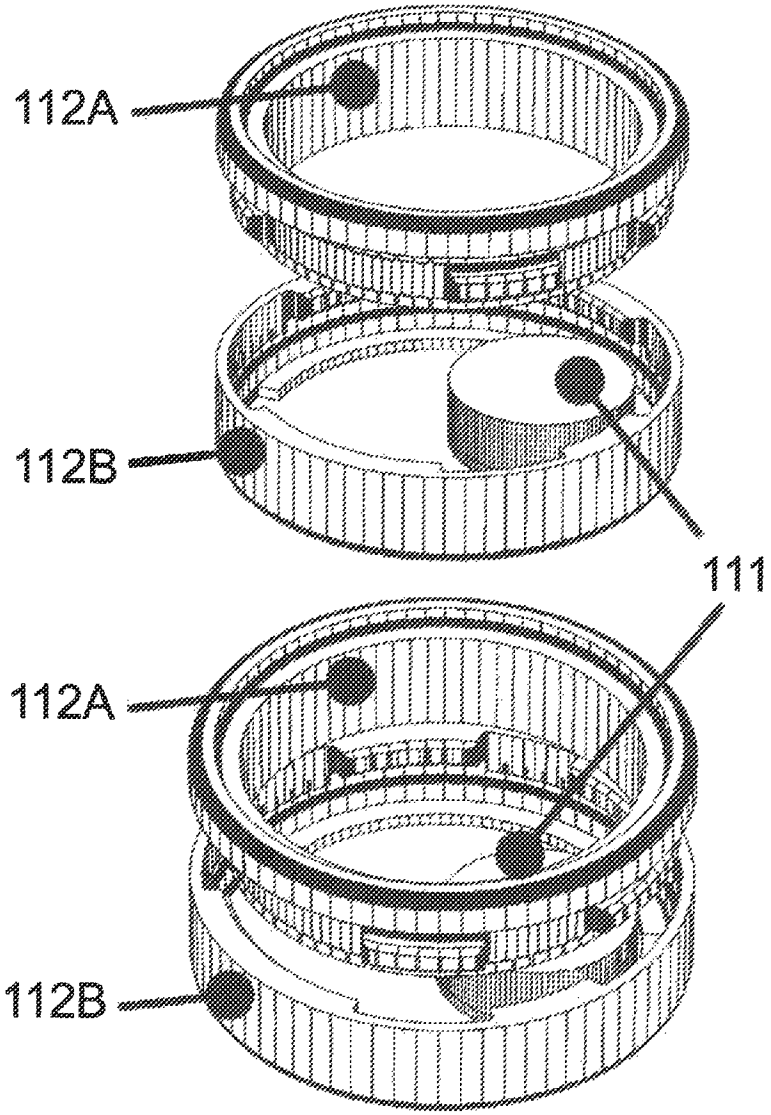
FIG. 2: timepiece with a primary casing 111 and with wide (above) and less wide (below) open top part 112A and bottom part 112B of the secondary casing.

The geometry of bottom part and top part of the secondary watch case allows opening or closing thereof by a single manual operation without tool. For this purpose, the top and bottom pads are at first centered in a defined rotational position relative to one another. Then, there is a movement along the common rotation axis (=center axis) until the bottom part and the top part mechanically strike each other and no separation gap can be seen from the outside. Fig. 2 shows a wide opening in the upper region between top part and bottom part of the secondary casing. FIG. 2 below shows a smaller distance from one another after axial displacement has already taken place. The completely closed secondary casing is shown in FIG. 1. The top and bottom parts are formfittingly connected by a subsequent rotary movement about the common center axis. For this purpose, the undercuts that are unevenly distributed around the circumference interlock.

As shown, this can be realized in such a way that top part and bottom part each have an interrupted edge which projects radially inwards or outwards, with interruptions and edge pieces being arranged in a complementary manner. Where the edge of the bottom part has an interruption, the edge of the top part accordingly has an edge piece, and vice versa.

Figure 7:
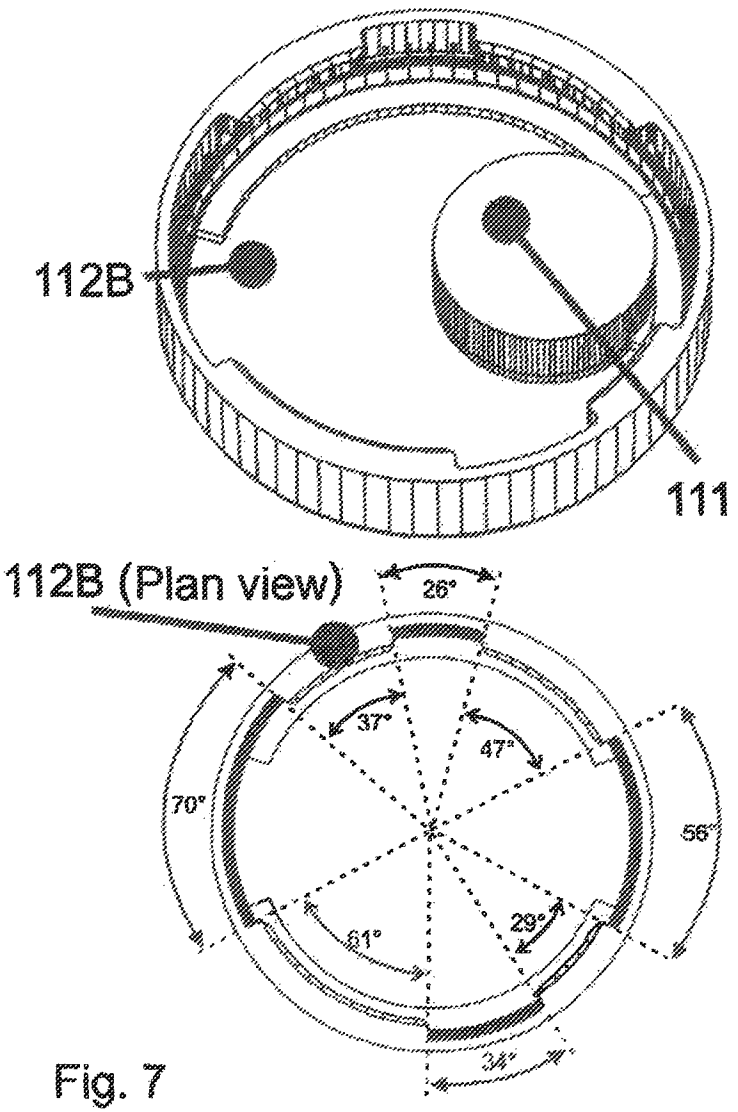
FIG. 7: bottom part 112B of the secondary casing with inserted primary casing 111 and the opening angles [56°, 34°, 70°, 26°], which are provided for the axial insertion of the top part.
Figure 9:
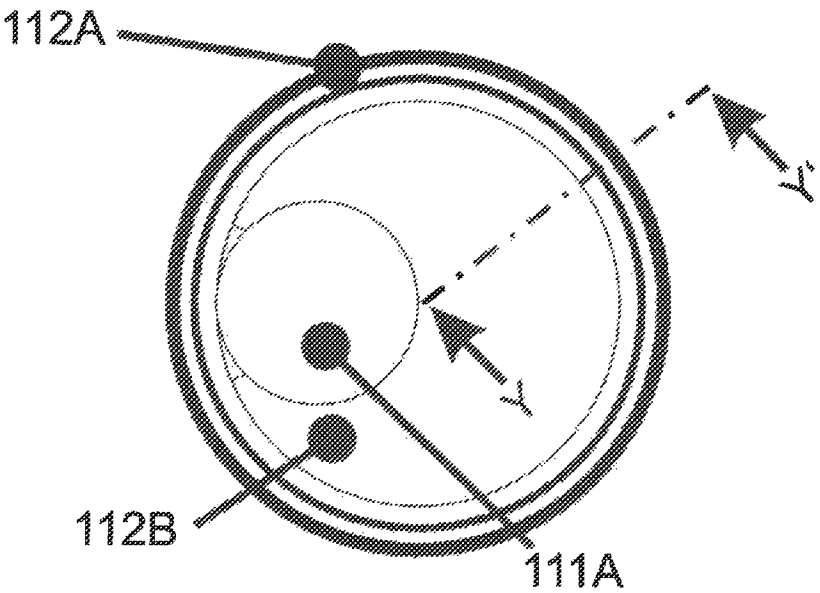
FIG. 9: top view (above) of a professionally customized timepiece with a sectional view (below) of the secondary casing at 1:30 o'clock (top part of the secondary casing rotated clockwise by 45° for closure)
Figure 9:
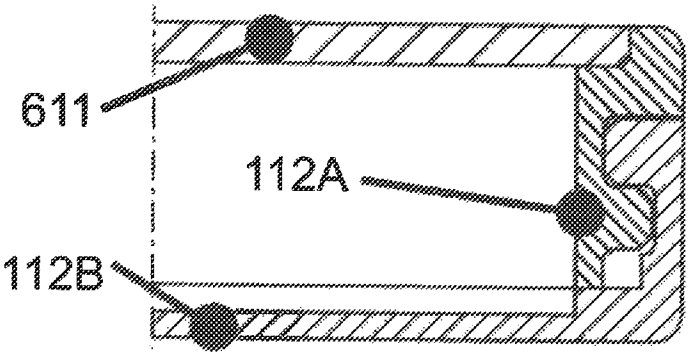
Figure 17:
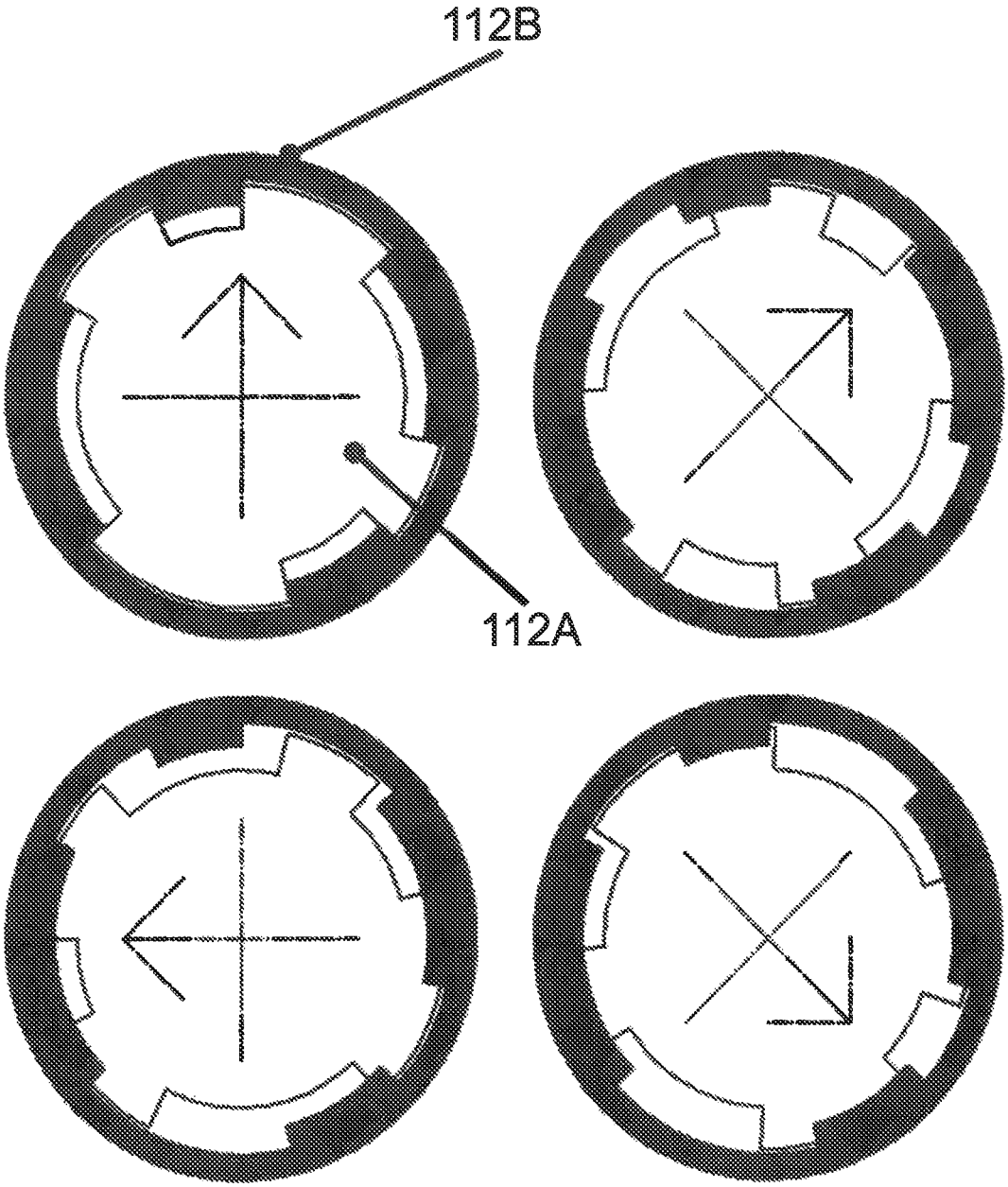
FIG. 17: schematic illustration of top part and bottom part of the secondary casing having non-symmetrical edges for release in only one angular position (top left).

The uneven distribution is shown, by way of example, in FIG. 7 on the bottom part of the secondary casing. The unevenness ensures that at any rotation angle, at least three undercuts engage one another and that the top part can only be lifted off in a single angular position (FIG. 17 top left). The interaction of the undercuts of top part and bottom part of the secondary casing is shown, by way of example, in Fig. 9 below. The section Y-Y' (FIG. 9 below) shows the form fit between (112A) and (112B).

Figure 8:
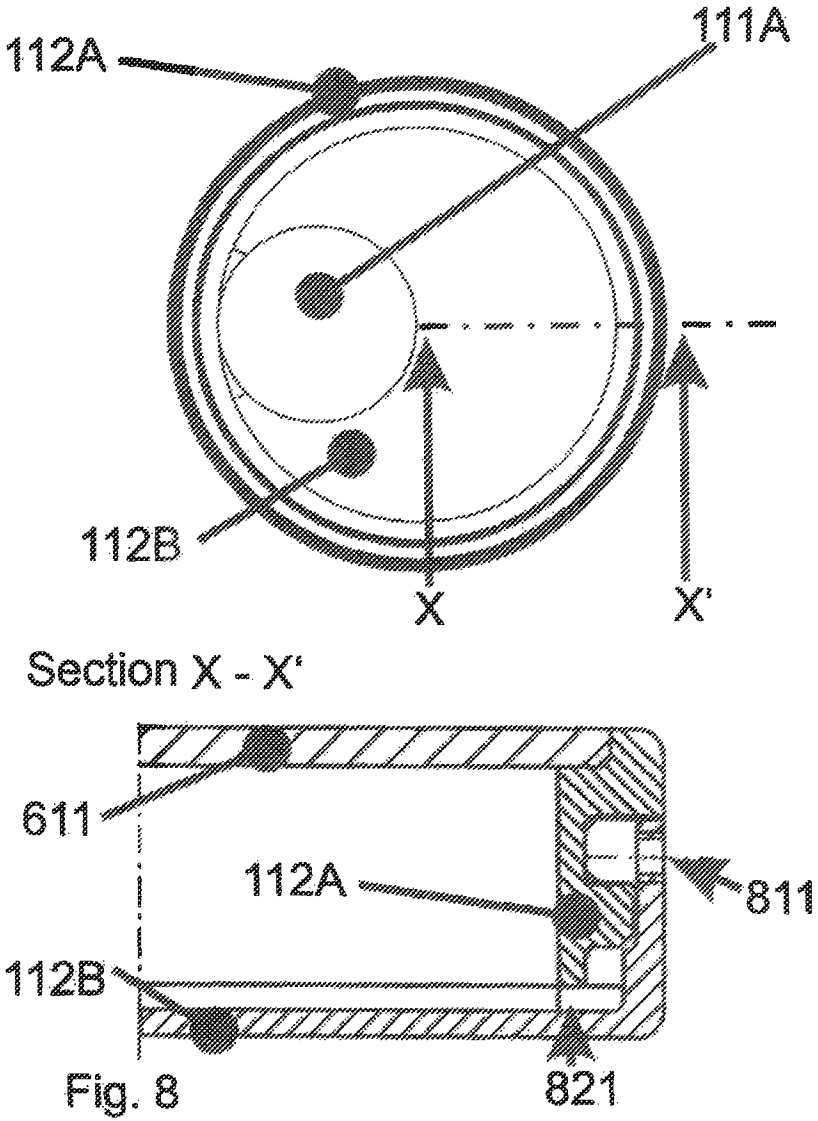
FIG. 8: top view of a professionally customized timepiece with a sectional view of the secondary casing at 3 o'clock.

The afore-described manual operation simultaneously secures the position of the primary watch case inside the secondary watch case. A preferred geometry 111A on the primary casing 111 for the defined receptacle is shown in FIG. 5. It has the shape of the flat outer edge 111A of a piece of pie, here with an opening angle of 45°. This outer edge 111A is inserted into the recess 521 provided for this purpose in the bottom part of the secondary casing. After insertion, the primary casing is fixed in five degrees of freedom and can only be removed again by a displacement along the center axis. This last degree of freedom is blocked by the closure of bottom part and top part of the secondary casing at the same time. FIG. 8 shows by way of section X-X' the defined gap (821), remaining after the top part (112A) and bottom part (112B) have been joined together, for the outer edge (111A). The receiving space for further design elements (311) is defined by the interior space in the secondary casing minus the volume of the primary casing.

A securing element prevents an inadvertent opening of the secondary casing. For example, a screw, possibly with a knurled head or similar crown, may find application as a securing element. In a preferred embodiment, this screw is threadably engaged via a thread (811, FIG. 8) in the bottom part of the secondary casing. It engages in the circumferential groove in the top part of the secondary casing (112A). Depending on the screw-in depth, the screw either only secures the secondary casing against unintentional opening or at the same time realizes a fixation of the rotational degree of freedom of the secondary casing.

In a further embodiment, the two functions "securement of the secondary casing against unintentional opening" and "fixation of the rotational degree of freedom of the top part of the secondary casing" are divided over two screws. As an alternative to the screws, other securing elements, like e.g. pins, can be used.

In a preferred embodiment, the primary watch case in the secondary watch case is stationary and completely surrounded by the secondary watch case and all adjustment elements, such as crowns and pushers, are exclusively attached to the primary watch case. As a result, time and, optionally, stopwatch functions are possible only after opening of the secondary casing and removal of the primary casing. Therefore, the primary casing may be easily removed at any time as soon as the top part of the secondary casing has been removed from the bottom part of the secondary casing.

In a further preferred embodiment, the primary casing is arranged off-center in the secondary casing. The top part of the secondary watch case has always an unlimited rotational degree of freedom about its center axis after assembly. In conjunction with the eccentrically arranged primary casing (111) and also the off-center arrangement of optical elements, e.g. lenses, optical filters or prisms, on the sight glass (611) of the secondary casing, optical effects can be generated. The view of the time or the view of individual elements can be enlarged e.g. with a lens with positive diopter number. In addition, light elements, e.g. luminescent foils or miniature light-emitting diodes, that have been introduced into the interior space expand the optical appearance.

In a further preferred embodiment, the female or male watch wearer is provided with a largest possible receiving space for individual adjustments in the secondary watch case. For this purpose, a primary casing occupies less than 50% and preferably less than 30% of the volume enclosed by the secondary casing. Furthermore, the need for minimizing elements, like e.g. central rotation axes, is completely eliminated.

In a further preferred embodiment, the secondary casing is comprised of no more than two parts, which individually have a volume greater than 1,000 (one thousand) cubic millimeters, preferably 500 (five hundred) cubic millimeters. These are bottom part of the secondary casing (112B) and top part of the secondary casing including sight glass (112A, 611). This minimal number of individual parts is necessary to keep the outer diameter at dimensions that are accepted by the customer, while at the same time having a maximum receiving space inside the secondary casing. The diameter of the secondary casing (without attachment elements and crowns) shall not exceed 42 mm for women and 46 mm for men.

In a further preferred embodiment, the individually customizable timepiece is realized in a unisex variant with a diameter of the secondary casing (without attachment elements and crowns) of less than or equal to 41 mm.

Yet another embodiment provides for the primary casing to have more than two different, off-center recesses (511, 521) in the bottom part of the secondary casing. This enables variation in the position of the primary casing or the defined installation of several primary casings or several receptacles for other creative elements.

Another embodiment provides for the introduction of sealing materials into the separation gaps between the top part and the bottom part of the secondary casing.

A still further embodiment provides pushers in the outer region of the secondary casing, via which either "by wire" or "wireless" clock functions are controlled in combination with analog or LCD displays.

Figure 11:
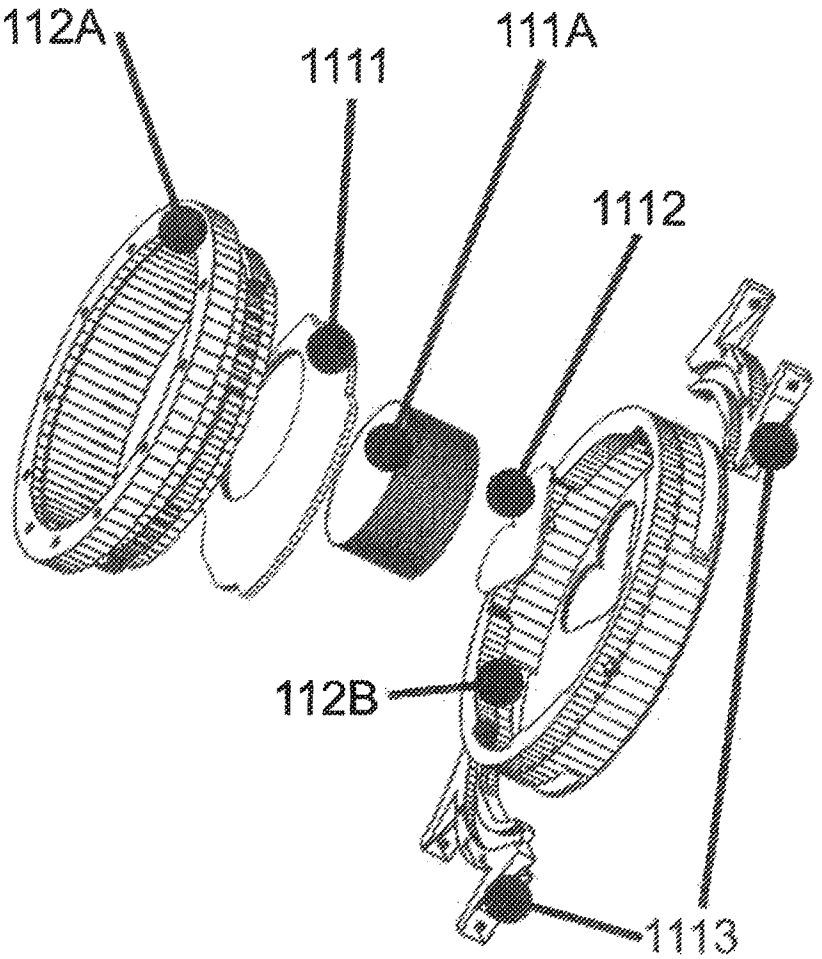
FIG. 11: exploded illustration of a preferred embodiment with exchangeable band lugs (1113), which are inserted laterally from 12 o'clock and 6 o'clock into a slotted bottom part 112B of the secondary casing and formfittingly connected by closing the top part of the secondary casing (112A)

A further preferred embodiment according to FIG. 11 provides for exchangeable band lugs (1113) and a heart-shaped positioning element (1112). The embodiment shown in an exploded view is mounted in the following steps, again preferably without the use of tools.

Figure 12:
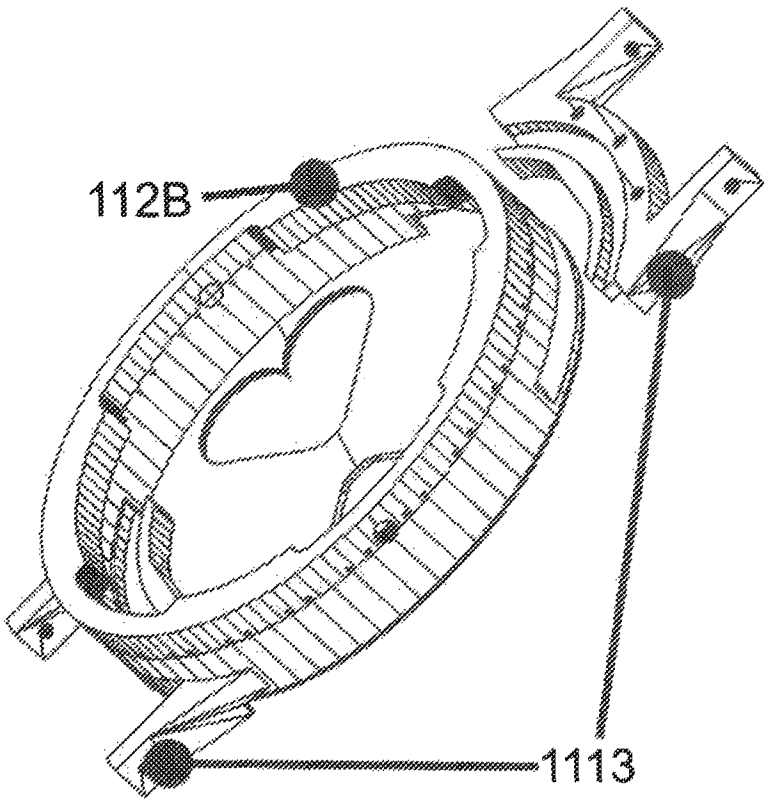
FIG. 12: 3D representation of a preferred embodiment with exchangeable band lugs (1113), with the band lug separated at 12 o'clock (top right) and the band lug Inserted at 6 o'clock (bottom left) into the slotted bottom part 112B of the secondary casing.
Figure 13:
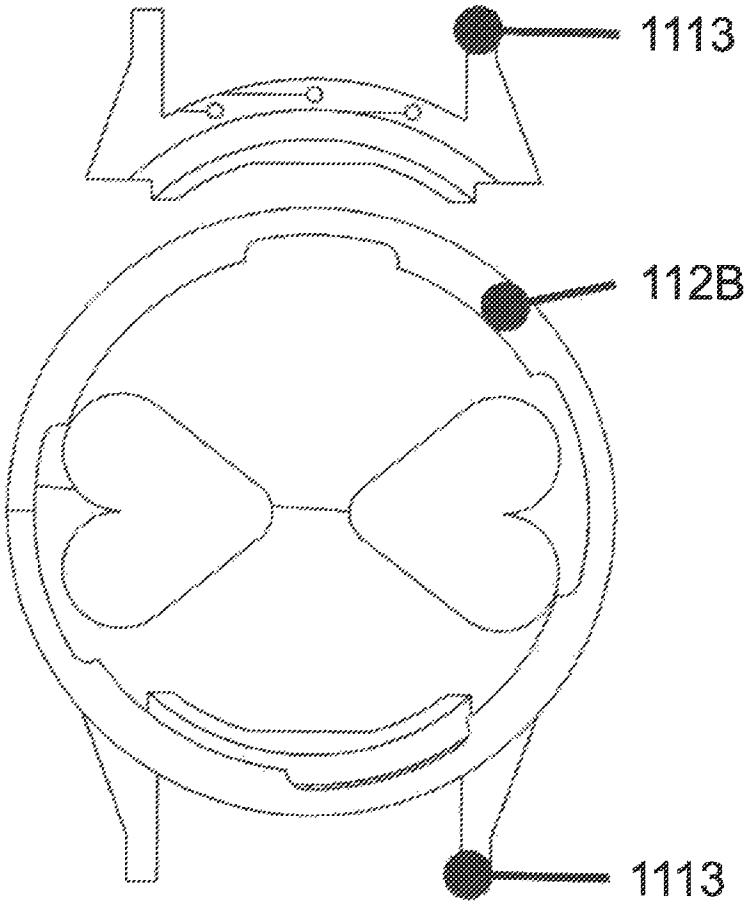
FIG. 13: top view of a preferred embodiment with exchangeable band lugs (1113), with the band lug separated at 12 o'clock (above) and the band lug inserted at 6 o'clock (below) into the slotted bottom part 112B of the secondary casing.

1. The band lugs are inserted laterally from 12 o'clock and 6 o'clock into the slotted bottom part 112B of the secondary casing (detailed views of the slotted bottom part 112B of the secondary casing with respectively separated and mounted band lug are shown in FIGS. 12 and 13).

Figure 14:
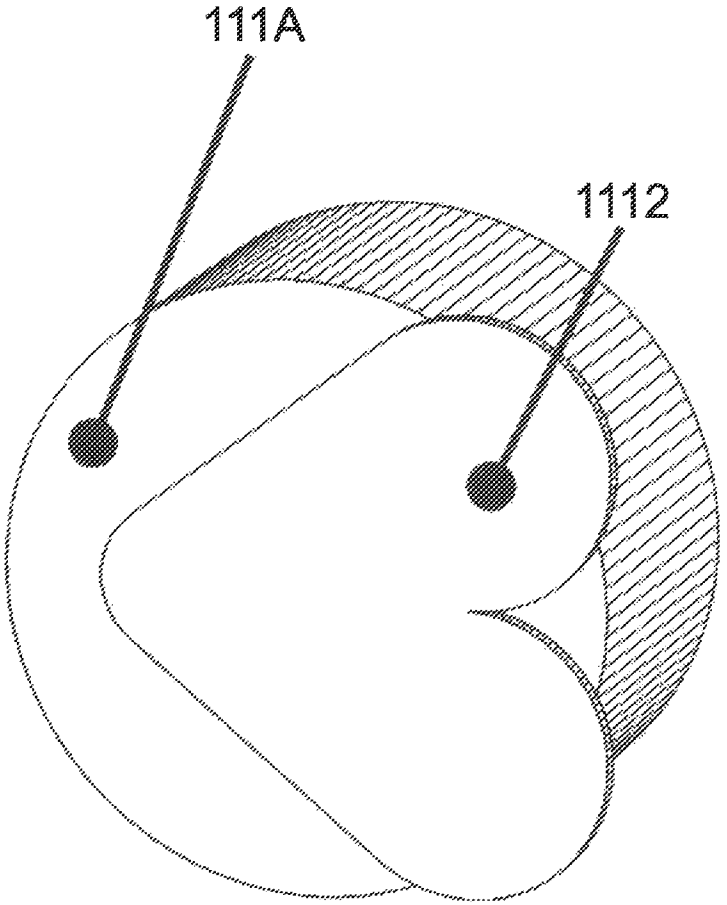
FIG. 14: primary casing (111A) which, before being installed in the secondary casing, is connected with a heart-shaped positioning element (1112) by a material joint, form fit or interference fit to form a unit.

2. The primary casing (111A) is connected to a heart-shaped positioning element (1112) to form a unit before installation in the secondary casing (FIG. 14). Instead of the heart shape, the positioning element could also have other geometric shapes (whereby it is preferably non-circular in order to realize a rotationally fixed positioning).

Figure 15:
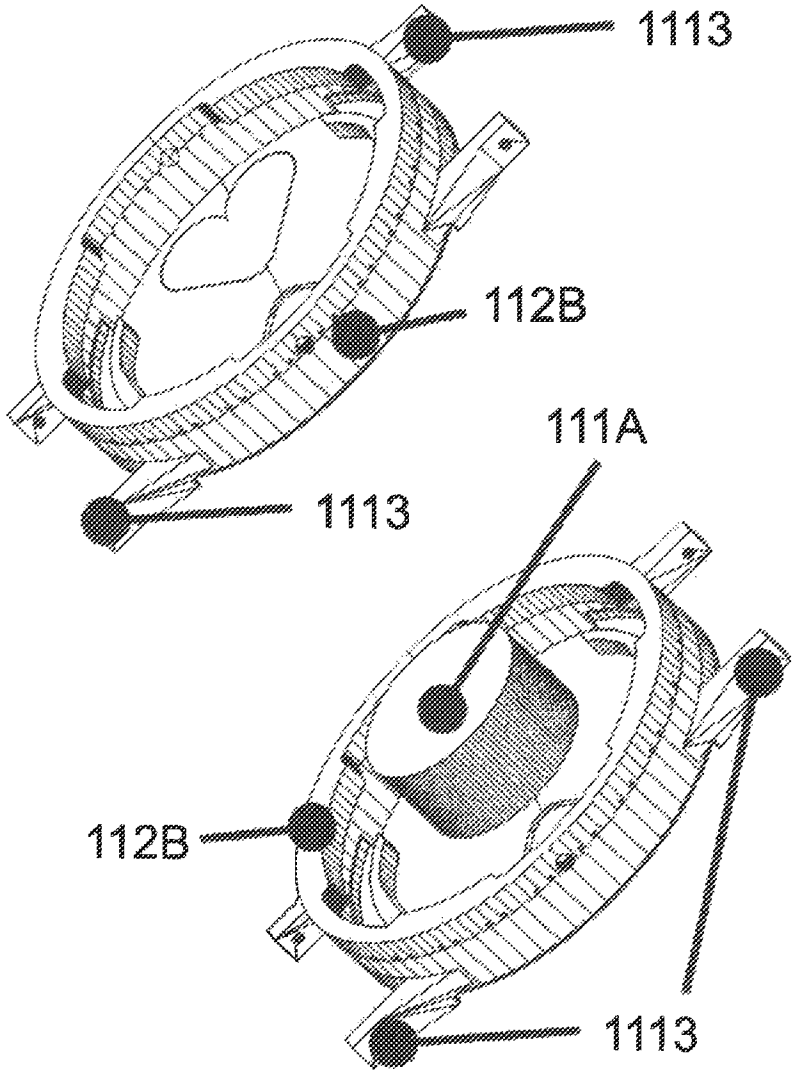
FIG. 15: bottom part 112B of the secondary casing with band lugs (1113), formed on top with visible heart-shaped milling for receiving the positioning element (1112) and at the bottom with mounted unit comprised of the primary casing (111A) and heart-shaped positioning element (1112)

3. The unit comprised of primary casing (111A) and heart-shaped positioning element (1112) is inserted into the also heart-shaped recess in the base of the bottom part 112B (FIG. 15)

4. The insert plate (1111) shown in FIG. 1 is positioned.

Figure 16:
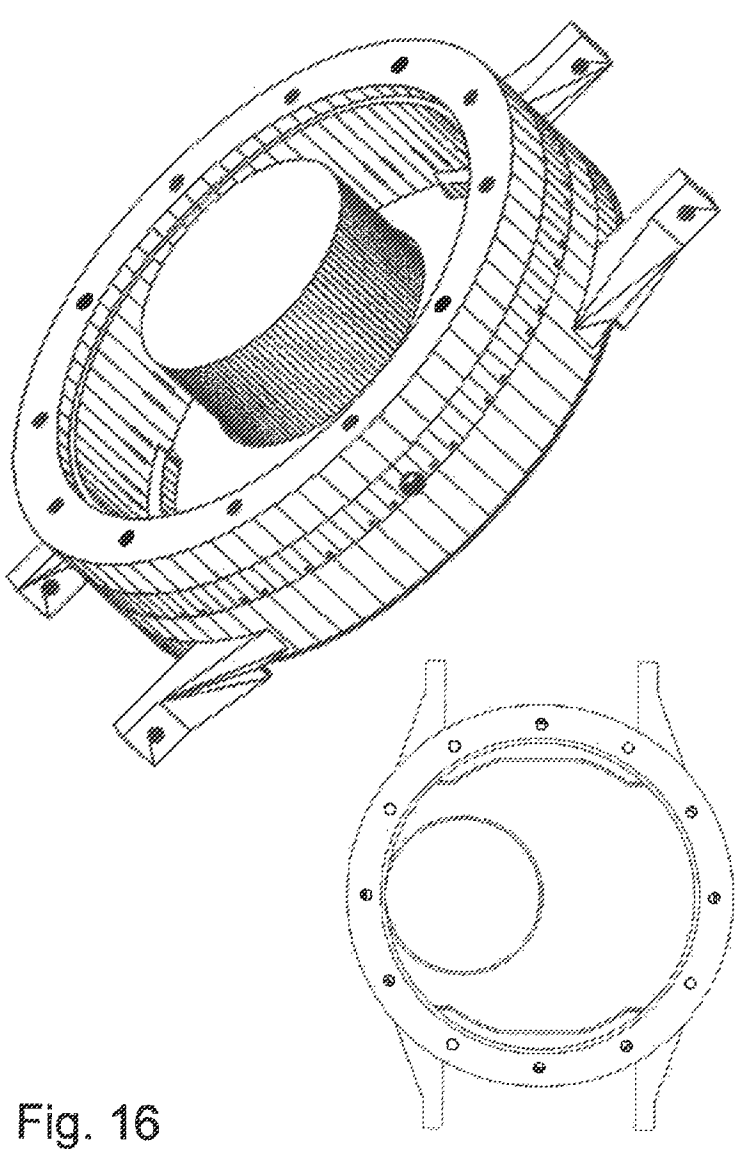
FIG. 16: assembly of the exploded view from FIG. 11.
Figure 18:
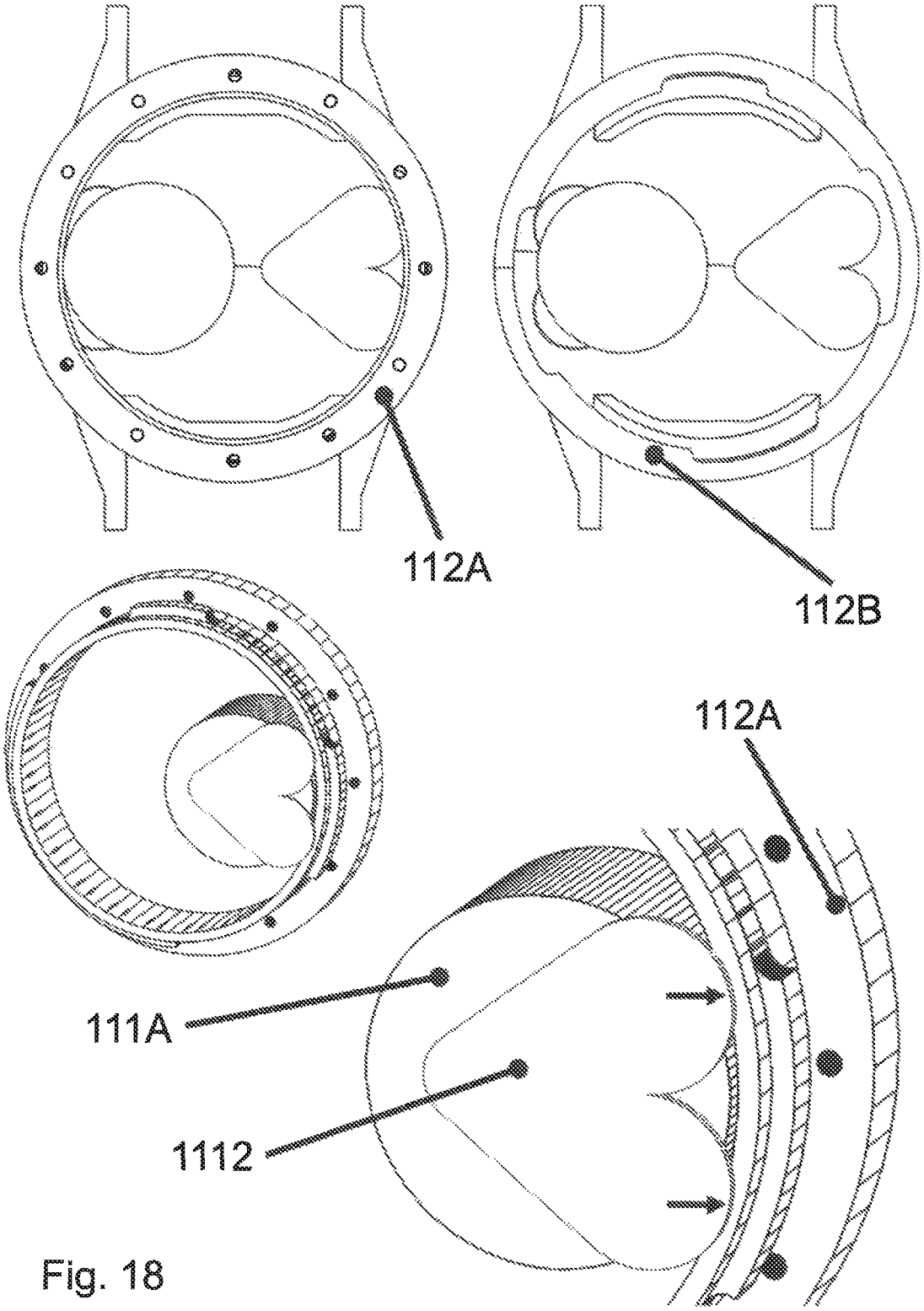
FIG. 18: timepiece with (top left) and without (top right) upper part of secondary casing indicating how positioning element is clamped down in assembled condition (arrows at bottom right indicate contact zone).

5. By mounting the top part (112A), all elements in the assembly are formfittingly connected to each other (Figs. 16 and 18).

In the described embodiment, the position of the positioning element (1112) in relation to the primary casing (111A) is variable. In conjunction with a modification of the circular recess in the insert plate (1111), differently sized primary casings can be positioned at any location within the secondary casing (112). The exchangeable band lugs (1113) may also be used in conjunction with different positioning devices for the primary casing.

A further embodiment provides for the cover glass (611, FIG. 6) to be designed as a touchscreen film. A smartwatch module inserted into the secondary casing is positioned in such a way that its user interface is in direct contact with the touchscreen film (611). As a result, the smartwatch module can be operated without opening the secondary casing.

Furthermore, the primary casing may include at least one electronic movement, which has analog hand displays or LCD displays, and/or contain a mechanical movement, which has analog hand displays or rotary disks with numbers that can be adjusted in an analog manner.

Furthermore, only two parts with a material volume greater than eight hundred and fifty cubic millimeters can form the secondary casing, these two parts are the bottom part and the top part of the secondary casing including sight glass, with all other parts of the secondary casing having a material volume of less than eight hundred and fifty cubic millimeters.

All described embodiments are exemplary. They may find application also in combination and describe the achievable variants in detail, but not exhaustively.

The invention claimed is:

1. A professionally customizable timepiece in form of a wrist watch, said timepiece comprising:

a primary casing including a movement and configured to operate independently as a timepiece; and a secondary casing having a top part, a bottom part, and a center axis and an interior space for receiving the primary casing and further design elements, said secondary casing configured to completely enclose the interior space and to enable opening thereof without tool for placement of the primary casing and/or design elements into the interior space or to remove them from there, said top part of the secondary casing including a sight glass and configured to secure the primary casing at a selectable position in the interior space, said secondary casing including wristband lugs so that the timepiece is capable to be worn with a wristband of metal, leather, synthetic leather, rubber or plastic as the wrist watch, said top part and said bottom part of the secondary casing configured to enable opening or closing of the secondary casing by manual operation without tool, and said top part of the secondary casing mounted to freely rotate about the center axis in an assembled state without displacement of the primary casing, wherein the top and bottom parts of the secondary casing have on an outer circumference several, non-symmetrically interrupted edge sections, which, starting from a central symmetry axis, alternate on the circumference and complement to form a single circumferential edge to enable assembly of the top part and the bottom part with a displacement along the symmetry axis.

2. The timepiece of claim 1, wherein the primary casing has a center axis, with the center axes of the primary and secondary casings being not identical.

3. The timepiece of claim 1, wherein the primary casing is configured shockproof and tight against solid, liquid and gaseous media.

4. The timepiece of claim 1, further comprising a screw-like securing element, configured to prevent inadvertent opening of the secondary casing, said top part of the secondary casing being detachable from the bottom part of the secondary casing by hand and without further aids in only one angular position after removal of the securing element.

5. The timepiece of claim 1, further comprising a lens, attached off-center inside the secondary casing and mounted for rotation about a vertical axis of the secondary casing.

6. The timepiece of claim 1, further comprising a positioning element connectable to the primary casing and effecting a securement of the primary casing in the secondary casing.

7. The timepiece of claim 1, wherein the sight glass on the top part of the secondary casing is a touchscreen film and the wrist watch is a smartwatch module situated inside of the secondary casing in such a way that its user interface is in direct contact with the sight glass.

8. A professionally customizable timepiece in form of a wrist watch, said timepiece comprising:

a primary casing including a movement and configured to operate independently as a timepiece; and a secondary casing having a top part, a bottom part, and a center axis and an interior space for receiving the primary casing and further design elements, and secondary casing configured to completely enclose the interior space and to enable opening thereof without tool for placement of the primary casing and/or design elements into the interior space or to remove them from there, said top part of the secondary casing including a sight glass and configured to secure the primary casing at a selectable position in the interior space, said secondary casing including wristband lugs so that the timepiece is capable to be worn with a wristband of metal, leather, synthetic leather, rubber or plastic as the wrist watch, said top part and said bottom part of the secondary casing configured to enable opening or closing of the secondary casing by manual operation without tool, and said top part of the secondary casing mounted to freely rotate about the center axis in an assembled state without displacement of the primary casing, wherein the top and bottom parts of the secondary casing have a rotational degree of freedom of 360 degrees to each other when assembled, yet are formfittingly connected in the remaining five degrees of freedom by engaging undercuts.

9. The timepiece of claim 8, wherein the top part and the bottom part of the secondary casing each have non-symmetrically interrupted edges of different angular extension that arrange together in a complementary manner to achieve both, firstly said interrupted edges engaging in undercuts to connect upper and lower part in assembled state and secondly said non-symmetrically interrupted edges distribute and alternate on their common circumference in a way to limit the opportunity for assembly or detachment of upper and lower part to only one angular position.

10. A professionally customizable timepiece in form of a wrist watch, said timepiece comprising:

a primary casing including a movement and configured to operate independently as a timepiece:

a secondary casing having a top part, a bottom part, and a center axis and an interior space for receiving the primary casing and further design elements, said secondary casing configured to completely enclose the interior space and to enable opening thereof without tool for placement of the primary casing and/or design elements into the interior space or to remove them from there, said top part of the secondary casing including a sight glass and configured to secure the primary casing at a selectable position in the interior space, said secondary casing including wristband lugs so that the timepiece is capable to be worn with a wristband of metal, leather, synthetic leather, rubber or plastic as the wrist watch, said top part and said bottom part of the secondary casing configured to enable opening or closing of the secondary casing by manual operation without tool, and said top part of the secondary casing mounted to freely rotate about the center axis in an assembled state without displacement of the primary casing; and a positioning element connectable to the primary casing and effecting a securement of the primary casing in the secondary casing, wherein the primary casing can be reproducibly placed and removed by its attached positioning element, said positioning element inserted into a likewise shaped recess in a base of the bottom part of the secondary casing and said positioning element clamped down by its contact to the top part of the secondary casing in the assembled state.

11. The timepiece of claim 10, wherein the positioning element has at least one portion protruding over an outer edge of the primary casing and same portion extending under an inside diameter of the upper part of the secondary casing, thereby being completely fixed in its position in the assembled state.

12. The timepiece of claim 11, wherein the bottom part of the secondary casing has between two and six different, off-center recesses to accommodate several positioning elements attached to more than one primary watch or design elements, respectively.

* * * * *